US009657537B2

(12) United States Patent
Riley et al.

(10) Patent No.: US 9,657,537 B2
(45) Date of Patent: May 23, 2017

(54) CENTRALIZER FOR USE WITH WELLBORE DRILL COLLAR

(71) Applicant: HALLIBURTON ENERGY SERVICES, INC., Houston, TX (US)

(72) Inventors: Benjamin Scott Riley, Houston, TX (US); Daniel Patrick Carter, Conroe, TX (US); Anup Sona, Pune (IN)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 14/913,797

(22) PCT Filed: Aug. 18, 2015

(86) PCT No.: PCT/US2015/045666
§ 371 (c)(1),
(2) Date: Feb. 23, 2016

(87) PCT Pub. No.: WO2016/043901
PCT Pub. Date: Mar. 24, 2016

(65) Prior Publication Data

US 2016/0290068 A1 Oct. 6, 2016

Related U.S. Application Data

(60) Provisional application No. 62/052,504, filed on Sep. 19, 2014.

(51) Int. Cl.
*E21B 17/10* (2006.01)
*E21B 17/16* (2006.01)

(52) U.S. Cl.
CPC ..... *E21B 17/1078* (2013.01); *E21B 17/105* (2013.01); *E21B 17/1042* (2013.01); *E21B 17/16* (2013.01)

(58) Field of Classification Search
CPC ..... E21B 47/011; E21B 17/1064; E21B 17/1014; E21B 17/1042; E21B 17/1007; E21B 17/1078
See application file for complete search history.

(56) References Cited

U.S. PATENT DOCUMENTS 1,863,740 A * 6/1932 Bettis ..... E21B 17/1042 166/241.4
2,045,629 A * 6/1936 Bettis ..... E21B 17/1042 175/325.5

(Continued)

FOREIGN PATENT DOCUMENTS

CA 2362872 5/2003

OTHER PUBLICATIONS

International Patent Application No. PCT/US2015/045666 , International Search Report and Written Opinion, mailed Oct. 27, 2015, 10 pages.

*Primary Examiner* — Kipp Wallace
(74) *Attorney, Agent, or Firm* — Kilpatrick Townsend & Stockton LLP

(57) ABSTRACT

A centralizer includes one or more centralizer fins radially extending from a body of the centralizer. The centralizer fins may include one or more chambers extending through the outer surfaces of the centralizer fins. The one or more chambers may change shape in response to a compression force being applied to the centralizer fins to cause the centralizer fins to deform. The centralizer fins may be deformed for installation of the centralizer in a drill collar. The centralizer may also include a split-ring clamp for coupling the centralizer to a drilling tool positioned in a through-bore of the centralizer body. The split-ring clamp may apply a load on the drilling tool in response to an end cap being torqued to an end portion of the centralizer body.

20 Claims, 9 Drawing Sheets

(56) References Cited

U.S. PATENT DOCUMENTS

| | | | | |
|---|---|---|---|---|
| 2,076,039 | A * | 4/1937 | Miller | E21B 17/1014 175/325.5 |
| 2,890,019 | A * | 6/1959 | Arps | E21B 17/1042 175/325.2 |
| 3,197,263 | A * | 7/1965 | Holcombe | E21B 17/1071 166/241.4 |
| 3,318,335 | A * | 5/1967 | Heller | F16J 15/52 138/121 |
| 5,566,754 | A * | 10/1996 | Stokka | E21B 17/1078 166/241.6 |
| 6,032,748 | A | 3/2000 | DeBray et al. | |
| 7,096,939 | B2 * | 8/2006 | Kirk | E21B 43/103 166/206 |
| 8,701,785 | B2 | 4/2014 | Nikiforuk et al. | |
| 2003/0024707 | A1 | 2/2003 | Angman et al. | |
| 2007/0074908 | A1 * | 4/2007 | Utter | E21B 17/07 175/57 |
| 2011/0000665 | A1 | 1/2011 | Chesnutt et al. | |
| 2012/0111640 | A1 | 5/2012 | Downie et al. | |
| 2014/0083773 | A1 * | 3/2014 | Minosyan | E21B 47/00 175/40 |
| 2014/0151026 | A1 * | 6/2014 | Andrigo | E21B 17/1042 166/241.6 |

* cited by examiner

CENTRALIZER FOR USE WITH WELLBORE DRILL COLLAR

CROSS-REFERENCE TO RELATED APPLICATIONS

This is a U.S. national phase under 35 U.S.C. 371 of International Patent Application No. PCT/US2015/045666, titled "Centralizer for Use with Wellbore Drill Collar" and filed Aug. 18, 2015, which claims benefit of and priority to U.S. Provisional Patent Application No. 62/052,504, titled "Centralizer for Use with Wellbore Drill Collar" and filed Sep. 19, 2014, the entirety of each of which is incorporated herein by reference.

TECHNICAL FIELD

The present disclosure generally relates to an assembly for a wellbore drill collar, and, more particularly (although not necessarily exclusively), to a centralizer that may fit into a wide range of drill collars for use with a drilling assembly for a wellbore.

BACKGROUND

Centralizers are devices that are used to radially space (and roughly speaking, to center) a tubing string or portion thereof from the inner diameter of a surrounding wellbore or outer tubular member. In the context of drilling a well, for example, a centralizer may be used along a drill string to substantially center the drill string or portion thereof within a wellbore. In some examples, a centralizer may be positioned internal to a drill collar of the drill string. The centralizer may be sized to allow an external portion of the centralizer to maintain contact with an inner surface of the drill collar. The size and placement of the centralizer in the drill collar may reduce vibrations in the centralizer or drill collar during operation of the drill string. The size of the centralizer may also ensure that the centralizer remains positioned to center the drilling tools in the wellbore.

Centralizers may be rigid and only positionable in a particular drill collar or a particular set of drill collars having a certain size. Centralizers that are not appropriately sized for a drill collar may not maintain contact with the inner diameter of the drill collar. Ill-fitting centralizers may result in diminished functionality of the centralizer. For example, the outer portion of the centralizer may not maintain contact with the inner diameter of the drill collar if a centralizer is too small for placement in a drill collar. This may result in the free movement or vibration of the centralizer during operation of the drill string. The movement or vibration of the centralizer may also result in the drill string departing from an intended drill path.

In some cases, a centralizer may be too large for placement internal to the drill collar. A remedy may be to trim or file the centralizer to allow the centralizer to fit into the drill collar. But, this remedy may be insufficient as it results in additional labor costs to trim the centralizer and additional time to ensure that the centralizer is trimmed to the appropriate size. Further, where a centralizer is not appropriately trimmed (e.g., where the trimming results in a centralizer that is too small for the intended drill collar), additional costs and time may be spent replacing the centralizer with an appropriately sized centralizer for the intended drill collar.

DETAILED DESCRIPTION

Certain aspects and features of the present disclosure relate to a centralizer that may fit into a wide range of drill collars for use with a drilling assembly for a wellbore. The term drilling assembly as used in the context of the described embodiments may broadly refer to a drill string or a portion thereof. A centralizer according to some examples may maintain contact with the drill collar inner diameter during operations and reduce vibration from ill-fitting centralizers. One example of a centralizer includes one or more fins extending radially from a body of the centralizer with chambers through a surface of the fins. The fins may be deformable to allow the centralizer to be compressed for positioning into an inner diameter of a drill collar. The centralizer may include a split-ring clamp to couple the centralizer to a drilling tool internal to the centralizer.

A centralizer according to some examples may be less stiff and be associated with a lower natural frequency, but may aid in reducing the chance that a field operator installs the wrong centralizer. Similarly, the centralizer may be useful to prevent a field operator from accidentally trimming the radially extending fins of the centralizer beyond a desired diameter, e.g., where a field operator trims too much material from the radially extending fins during installation of the centralizer in a drill collar. The centralizer may reduce vibration that downhole tools experience by maintaining contact with the inner diameter of a drill collar and not allowing one or more drilling tools in a drilling system to vibrate freely. The centralizer may be especially useful for air drilling applications in which vibration may be higher due to the lack of a heavy drilling fluid to dampen the drill string.

The terms "inner," "outer," "internal," and "external" as used in the present disclosure may refer to a radial orientation toward or away from the center axis of the centralizer.

Figure 1:
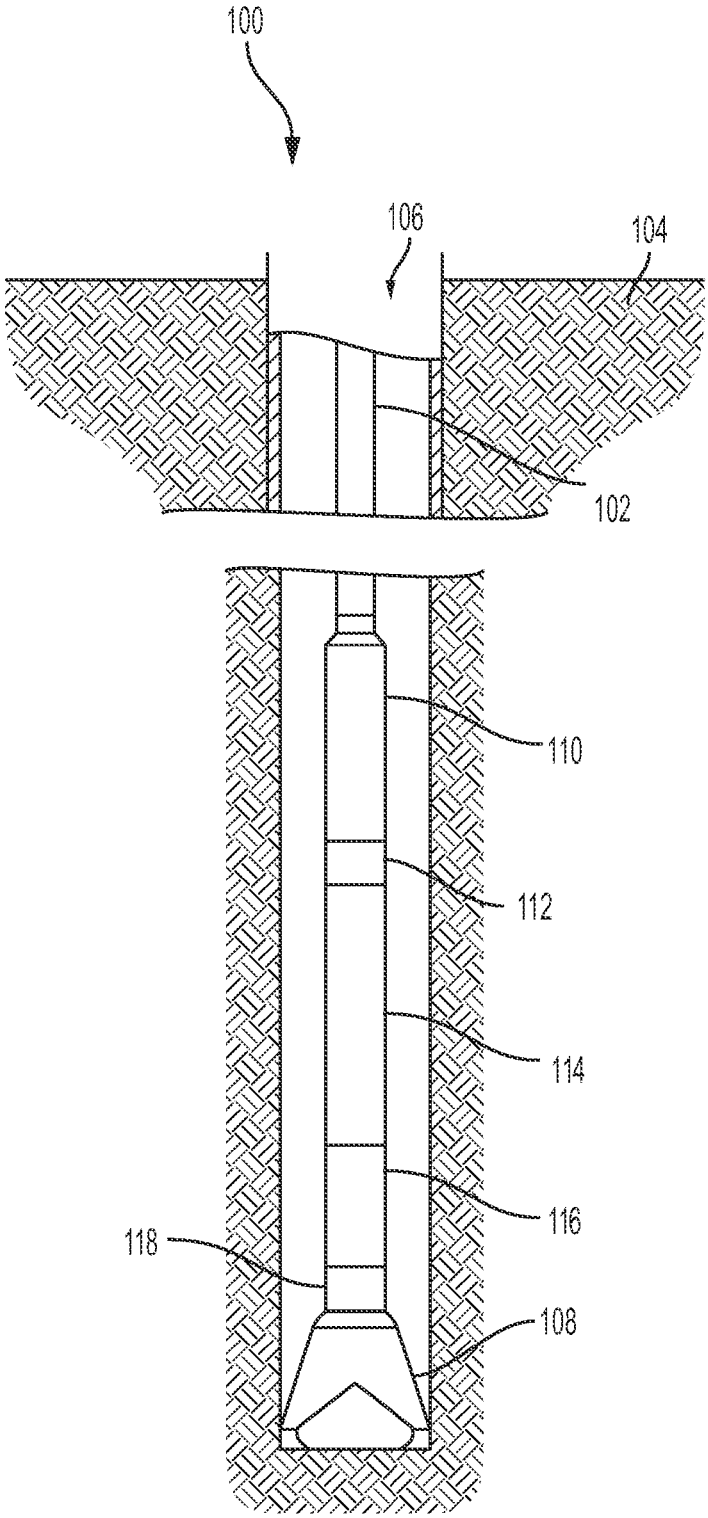
FIG. 1 is a cross-sectional schematic view of an example of a drilling system for a wellbore that includes a drill collar having a centralizer internal to the drill collar according to one aspect of the present disclosure.

Various aspects of the present disclosure may be implemented in various drilling systems. FIG. 1 illustrates an example of such a drilling system 100. Drilling system 100 includes a drill string 102 of a drilling rig (not shown) that extends below a surface 104 into a wellbore 106. The drill string 102 may transmit drilling fluid (or mud) and the torque necessary to operate a drill bit 108. The weight of the drill string 102 may provide an axial force on the drill bit 108.

The drilling system 100 includes a logging-while-drilling ("LWD") tool 110 positioned in the wellbore 106. The LWD tool 110 may include various modules, e.g., a measuring-while-drilling ("MWD") module 112, a compensated dual resistivity ("CDR") module 114, a saver sub 116, and a bit sub 118. The LWD tool 110, using the modules may transmit measurements of one or more characteristics (e.g., characteristics of wellbore 106) to the surface 104. Characteristic measurements may be transmitted to the surface 104 in real-time while the LWD tool 110 is positioned in the wellbore 106. The bit sub 118 may be coupled to the drill bit 108 by a drill collar that may include a centralizer according to the present disclosure.

Another example of a drilling system that may implement aspects of the present disclosure is an air drilling system. Due to the lack of a heavy drilling fluid to dampen a drill string, vibration of components of an air drilling system may be significantly increased as compared to components of a drilling system such as drilling system 100. The vibration-reduction capabilities of a centralizer according to the present disclosure may be desirable to ensure that components of the air drilling system are not permitted to vibrate freely.

Figure 2:
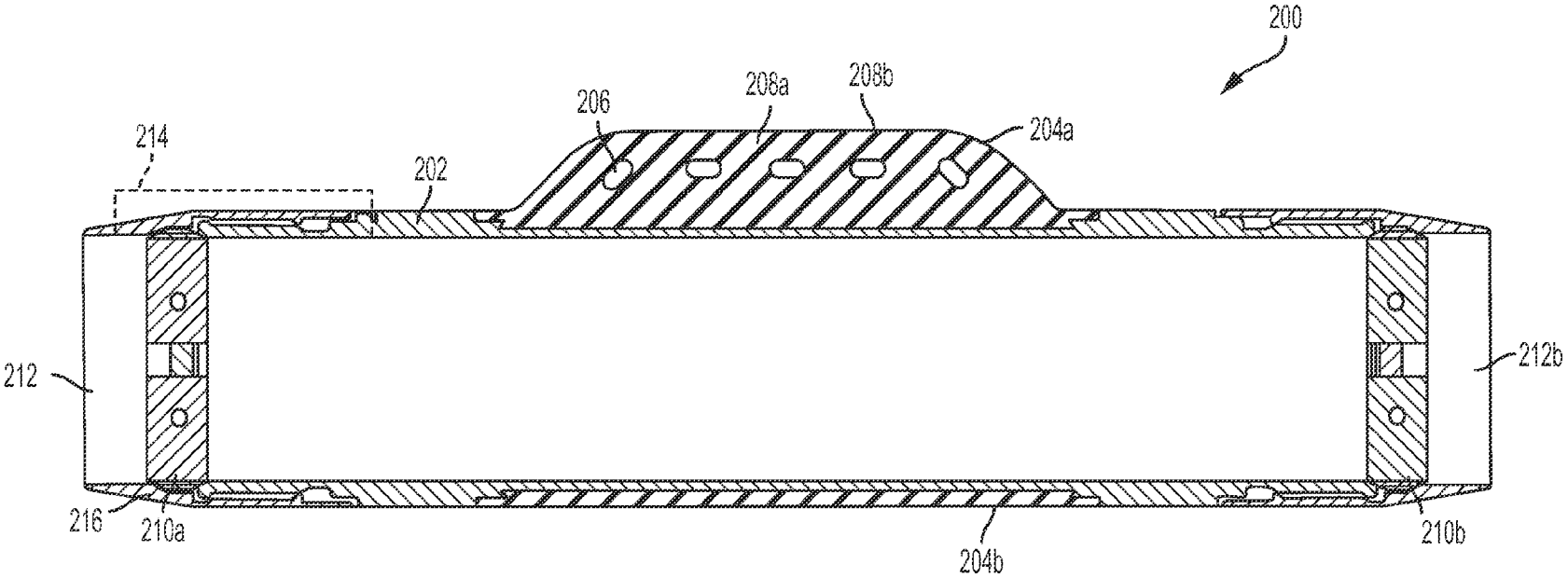
FIG. 2 is a cross-sectional side view of a centralizer according to one aspect of the present disclosure.

FIG. 2 is a cross-sectional side view of an example of a centralizer 200 for a drill collar. The centralizer 200 includes a centralizer body 202. The centralizer body 202 may include a through-bore to allow a drilling tool of the drilling system 100 (e.g., a sonde) to be positioned internal to the centralizer 200. In some aspects, the centralizer body may have a cylindrical shape. In other aspects, the centralizer body 202 may have any other shape. In some aspects, the shape of the centralizer body 202 may correspond to the shape of the drill collar in which the centralizer 200 may be installed. The centralizer body 202 may have one or more fins radially extending from the centralizer body 202 (e.g., centralizer fins 204*a*, 204*b*) that may allow the centralizer 200 to deform easily for placement into a drilling tool, such as a drill collar. Although two centralizer fins 204*a*, 204*b* are shown, the centralizer 200 may include any number of centralizer fins, including one, extending from the centralizer body 202.

The centralizer fins 204*a*, 204*b* may include one or more chambers 206 to allow the centralizer fins 204*a*, 204*b* to deform. For example, when a compression force is applied to the centralizer fins 204*a*, 204*b* in a radial direction toward the centralizer body 202, the chambers 206 may deform or change shape to allow the centralizer fins 204*a*, 204*b* to deform. The compression force applied to the centralizer fins 204*a*, 204*b* may result in a decrease in the diameter of the centralizer 200 (from the outermost edges of the centralizer fins 204*a*, 204*b*) to allow the centralizer 200 to be inserted into a drill collar having an inner surface sized to receive the centralizer 200 in a deformed state. The chambers 206 may be holes, apertures, gaps, or other types of openings extending from an outer surface 208*a* of the centralizer fins 204*a*, 204*b* to an opposing outer surface 208*b* of the centralizer fins 204*a*, 204*b*. The chambers 206 may be deformable in response to a compression force applied to the centralizer fins 204*a*, 204*b* and may be of any size or shape. Also, the size and shape of each of the chambers 206 may vary individually.

In some aspects, the size of the chambers 206 may be inversely related to the diameter of the centralizer 200 when the centralizer fins 204*a*, 204*b* are fully deformed in response to a compression force. As a result, centralizer fins 204*a*, 204*b* having larger chambers 206 may be relatively more deformable than centralizer fins 204*a*, 204*b* having smaller chambers 206. Similarly, in alternative or additional aspects, the number of chambers 206 included on the centralizer fins 204*a*, 204*b* may be inversely related to the diameter of the centralizer 200 when the centralizer fins 204*a*, 204*b* are fully deformed. As a result, the more chambers 206 included in centralizer fins 204*a*, 204*b*, the more deformable the centralizer fins 204*a*, 204*b*. The fewer chambers 206 included in centralizer fins 204*a*, 204*b*, the less deformable the centralizer fins 204*a*, 204*b*. Although multiple chambers 206 are shown in the centralizer 200 of FIG. 2, any number of chambers 206 may be included in the centralizer fins 204*a*, 204*b*, including one.

Figure 3:
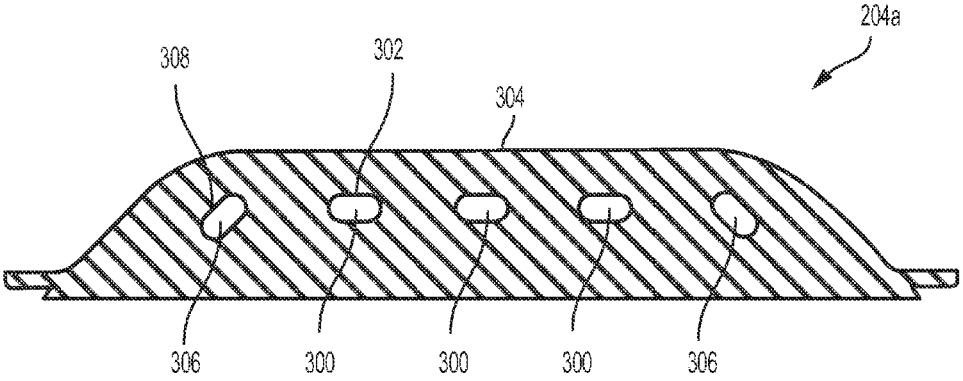
FIG. 3 is a cross-sectional isolated view of a centralizer fin of the centralizer of FIG. 2 according to one aspect of the present disclosure.

The shape and positioning of the chambers 206 may also affect how deformable the centralizer 200 may be when a compression force is applied to the centralizer fins 204*a*, 204*b*. FIG. 3 shows an isolated view of the centralizer fin 204*a* shown in FIG. 2. In some examples, the chambers 206 may have an oblong shape resembling a rounded rectangle and may be configured in a honeycomb-like pattern as shown in FIGS. 2 and 3. The chambers 206 may be arranged in the honeycomb-like pattern such that center chambers 300 include a flat end 302 that is parallel to an end surface 304 of the centralizer fin 204*a* (e.g., parallel to an axial axis of the centralizer 200). The pattern may also include end chambers 306 near the axial ends of the centralizer fin 204*a* having a flat end 308 positioned at an angle from the end surface 304 of the centralizer fin 204*a*. In other examples, the chambers 206 may be configured in other patterns depending on the specifications of the centralizer and the desired deformation of the centralizer fins 204*a*, 204*b* (or the desired minimum diameter of the centralizer 200) when a compression force is applied.

Figure 4:
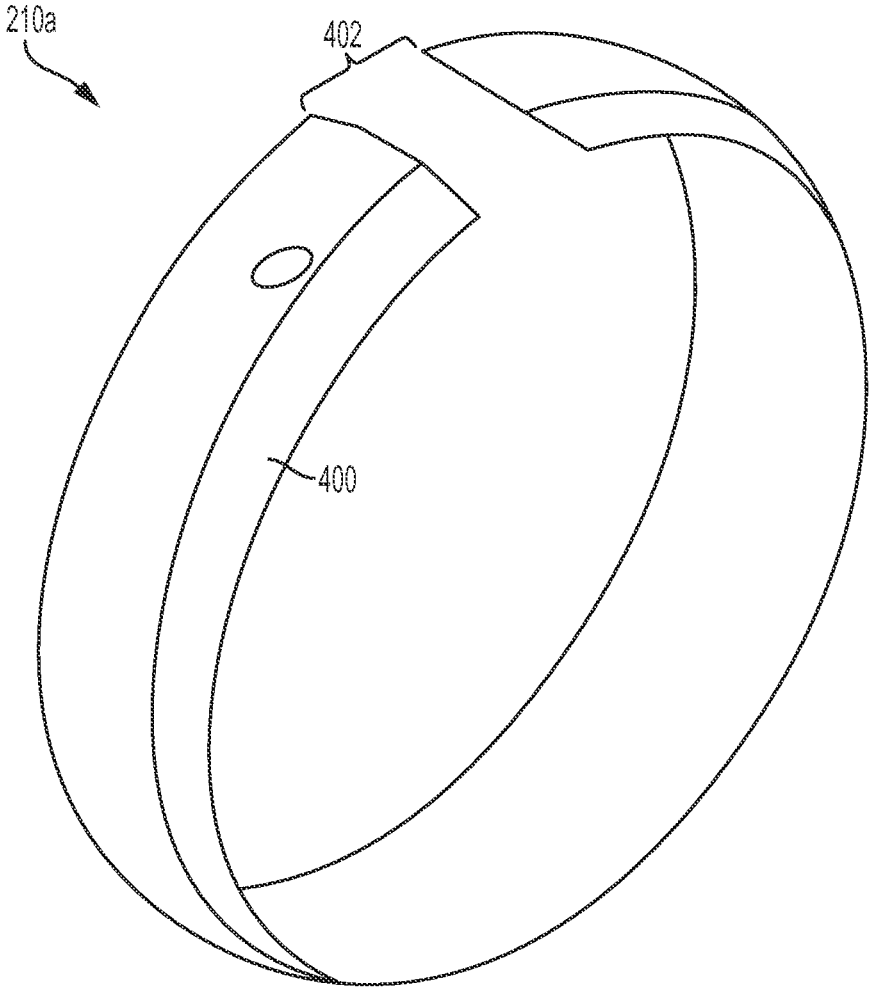
FIG. 4 is a perspective, angled view of a split-ring clamp for the centralizer of FIG. 2 according to one aspect of the present disclosure.

Referring back to FIG. 2, the centralizer 200 may also include one or more split-ring clamps 210*a*, 210*b* and one or more end caps 212*a*, 212*b*. The split-ring clamps 210*a*, 210*b* may be split-ring collets, split-ring shells, or other split-ring devices for coupling the centralizer 200 to a drilling tool internal to the centralizer body 202. FIG. 4 shows a perspective view of the split-ring clamp 210*a* of FIG. 2 as one example of a split-ring clamp that may be used. Although FIG. 3 shows split-ring clamp 210*a* as circular in shape, the split-ring clamps 210*a*, 210*b* may be of any shape corresponding to the centralizer body 202 (e.g., a circular split-ring clamp for a cylindrical centralizer body) or for encircling a drilling tool positioned in a through-bore of the centralizer body 202. The split-ring clamp 210*a* may include a tapered edge 400. The tapered edge 400 may correspond to and mate with a tapered edge included on the end cap 212*a* when the end cap 212*a* is torqued to or otherwise positioned on the centralizer body 202. The split-ring clamp 210*a* may also include a split 402 for allowing the split-ring clamp 210*a* to be positioned external to a portion of the centralizer body 202 or a drilling tool positioned in the through-bore of the centralizer body 202. The split 402 may further allow the split-ring clamp 210*a* to compress around a part of the drilling tool.

Figure 5:
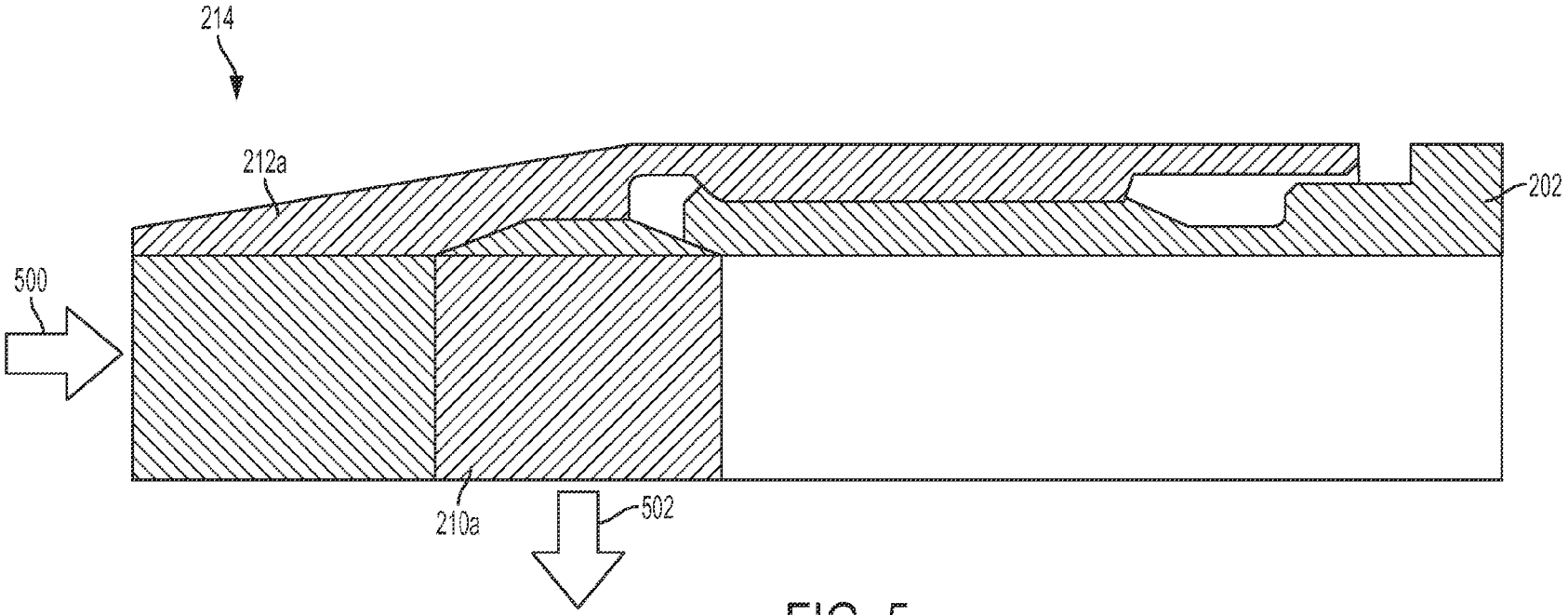
FIG. 5 is a cross-sectional side view of part of the centralizer of FIG. 2 according to one aspect of the present disclosure.

Referring back to FIG. 2, end caps 212*a*, 212*b* may be positioned over the end portions of the centralizer body 202. Block 214 identifies an example of a coupling of the centralizer body 202, the split-ring clamp 210*a*, and the end cap 212*a*. The coupling is shown in an enlarged view of block 214 in FIG. 5. The end cap 212*a* may be torqued in an axial direction 500 toward the centralizer body 202 to actuate the split 302 to allow the split-ring clamp 210*a* to compress around a part of the drilling tool positioned in the through-bore of the centralizer body 202. The split-ring clamp 210*a* may apply a load to the drilling component positioned internal to the centralizer body 202 in the radial direction 502 toward a center axis of the centralizer body 202 in response to the end cap 212*a* being torqued to the centralizer body 202.

The centralizer 200 may be made of any material being rigid sufficient to reduce vibrations of one or more drilling tools when positioned in a drill collar. Although rigid, the material of the centralizer may also have some flexibility to allow the centralizer fins 204*a*, 204*b* to deform when a compression force is applied. For example, the material of the centralizer 200 may be both rigid and flexible by allowing the centralizer 200 to deform only when one or more chambers 206 are included on the centralizer fins 204*a*, 204*b*. In some aspects, the centralizer 200 may include a rubber material or plastic material (e.g., polyetherketone, polyether ether ketone, UHMB, etc.). In additional and alternative aspects, the centralizer 200 may include more than one material (e.g., where the centralizer body 202 includes a steel material and the centralizer fins 204*a*, 204*b* include a rubber material).

Figure 6:
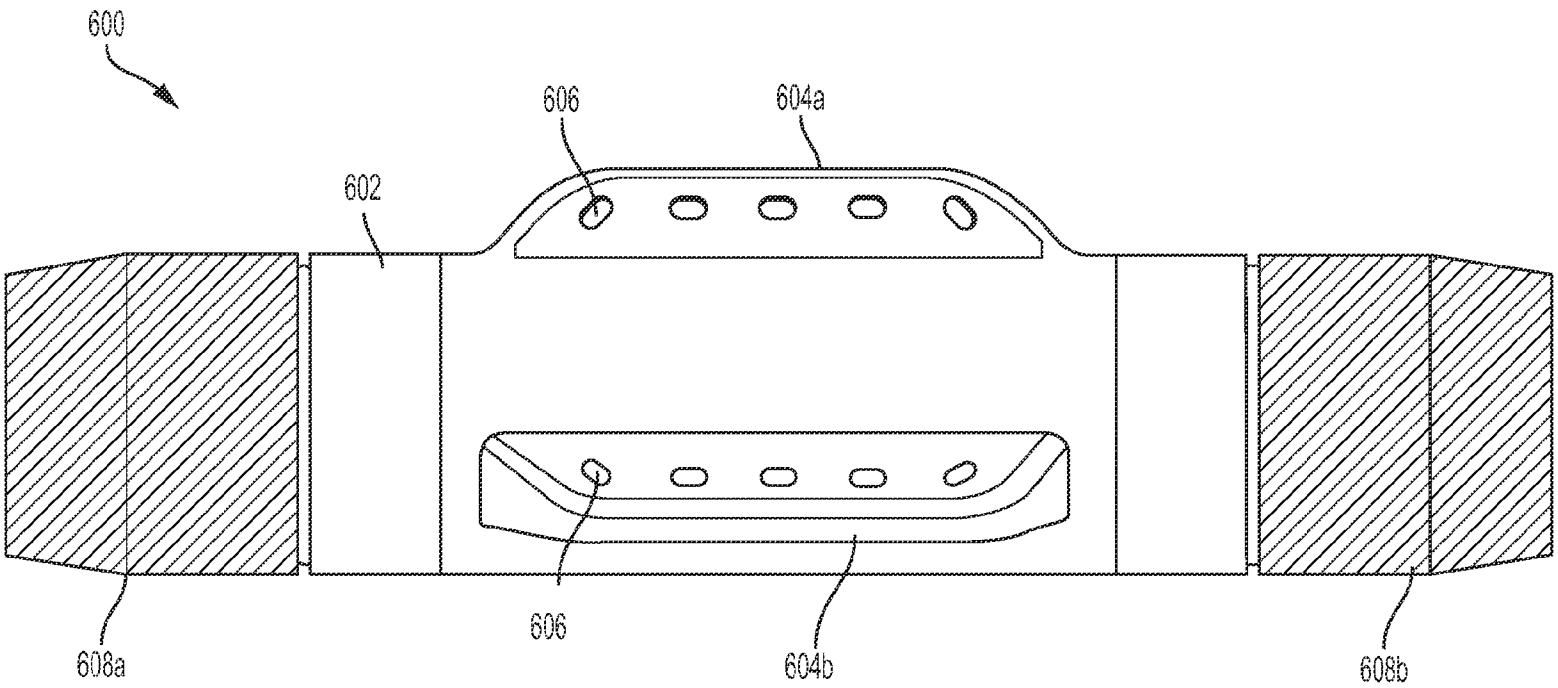
FIG. 6 is a perspective side view of a centralizer having end caps according to one aspect of the present disclosure.
Figure 7:
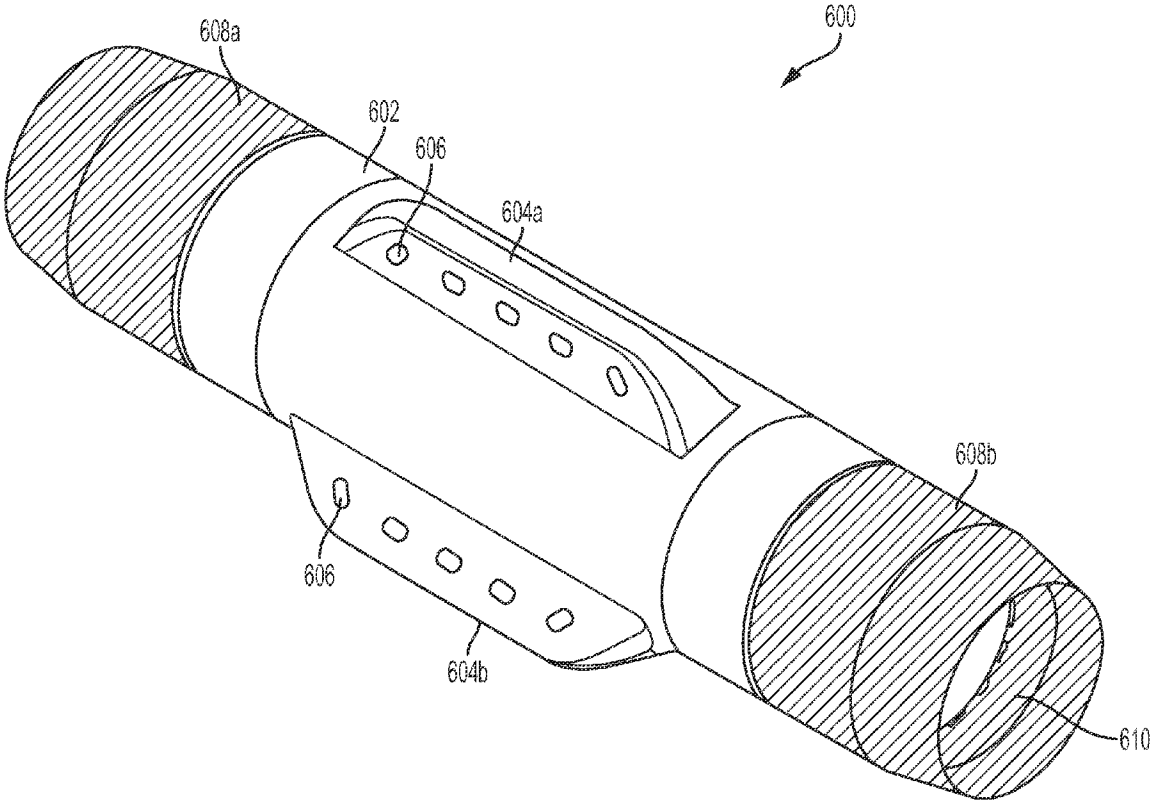
FIG. 7 is a perspective view of the centralizer of FIG. 6 according to one aspect of the present disclosure.
Figure 8:
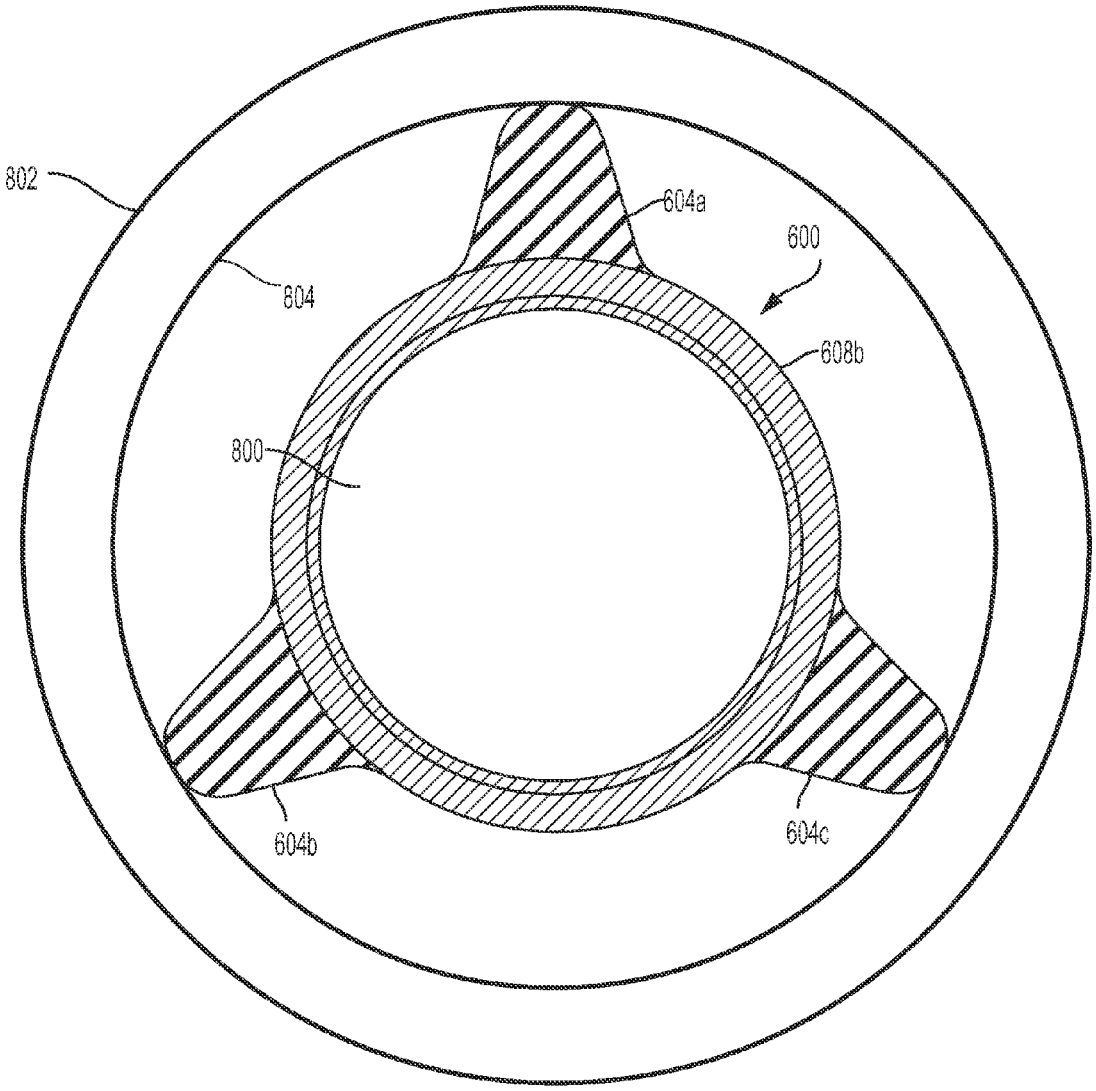
FIG. 8 is a cross-sectional end view of the centralizer of FIG. 6 according to one aspect of the present disclosure.

FIGS. 6-8 show a centralizer 600 having a centralizer body 602 and three centralizer fins 604*a*, 604*b*, 604*c*. The centralizer fins 604*a*, 604*b*, 604*c* include chambers 606 positioned in a honeycomb-like pattern similar to the chambers 206 shown in FIG. 2. FIG. 6 shows a side view of the centralizer 600. The centralizer 600 includes end caps 608*a*, 608*b* positioned on the end portions of the centralizer body 602. The end caps 212*a*, 212*b* may be made of any material having a resiliency for torquing to the centralizer body 602 (e.g., steel, rubber, etc.). FIG. 7 shows a perspective view of the centralizer 600. The centralizer 600 includes a split-ring clamp 610 positioned internal to end cap 608*b*. A split-ring clamp may also be positioned internal to end cap 608*a* in a similar position on the opposite end of the centralizer body 602. FIG. 8 shows an end view of the centralizer 600. The centralizer 600 and the end caps 608*a*, 608*b* include a through-bore 800. The through-bore 800 may be sized to allow a drilling tool (e.g., a sonde) to be positioned internal to the centralizer body 602. The split-ring clamp 210*a* may couple the centralizer 600 to a drilling tool internal to the centralizer body 602 by applying a load on the drilling tool in response to the end cap 608*b* being torqued to an end portion of the centralizer body 602. The centralizer 600 is positioned internal to a drill collar 802. Each of the centralizer fins 604*a*, 604*b*, 604*c* is in contact with an inner surface 804 of the drill collar 802. The contact between the centralizer fins 604*a*, 604*b*, 604*c* and the inner surface 804 of the drill collar 802 may reduce vibrations in the centralizer 600 or drill collar 802 during operation of the drilling assembly. The contact may further ensure that the centralizer 600 remains positioned in the drill collar 802 to center the drilling tools in the wellbore. The drill collar 802 may be made of any rigid material (e.g., steel). The inner surface 804 of the drill collar 802 may be sized to receive the centralizer 600 when the centralizer fins 604*a*, 604*b*, 604*c* are deformed to a maximum deformation point.

Figure 9:
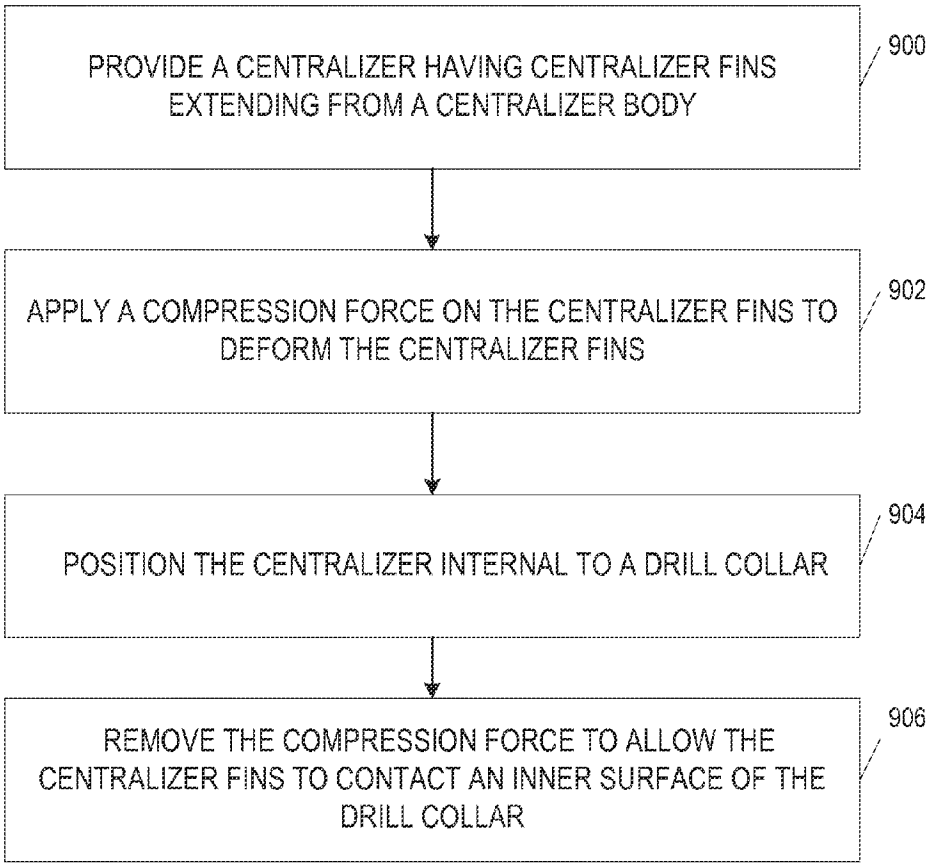
FIG. 9 is a flowchart depicting a process for installing the centralizer of FIG. 6 in the drill collar of FIG. 8 according to one aspect of the present disclosure.

FIG. 9 shows a process for installing the centralizer 600 in the drill collar 802. In block 900, a centralizer is provided. The centralizer 600 includes one or more centralizer fins 604*a*, 604*b*, 604*c* extending from a centralizer body 602 of the centralizer 600, as shown in FIG. 6. In block 902, a compression force is applied to at least one of the centralizer fins 604*a*, 604*b*, 604*c*. The compression force may deform the centralizer fins 604*a*, 604*b*, 604*c* to which the compression force is applied. In some aspects, the centralizer fins 604*a*, 604*b*, 604*c* may include chambers 606 that are positioned, sized, or shaped to allow the centralizer fins 604*a*, 604*b*, 604*c* to deform in response to the compression force. The compression force applied to the centralizer fins 604*a*, 604*b*, 604*c* may deform or otherwise alter the shape of the chambers 606 to deform the centralizer fins 604*a*, 604*b*, 604*c*. In additional or alternative aspects, the centralizer body 602 of the centralizer 600 may include a through-bore 800 as shown in FIG. 8. A split-ring clamp (e.g., split-ring clamp 210*a* of FIG. 4) may be positioned on a drilling component (e.g., a sonde) positioned in the through-bore 800 of the centralizer body 602 to couple the centralizer 600 to the drilling component. The split-ring clamp may further be on or adjacent to the centralizer body 602, as shown by the split-ring clamp 210*a* in FIG. 2. An end cap (e.g., end cap 212) may be torqued to the centralizer body to allow the split-ring clamp to apply a load on the drilling component.

In block 904, the centralizer 600 may be positioned internal to the drill collar 802. For example, the centralizer 600 may be inserted, slid, or otherwise placed in the drill collar 802 to position the centralizer fins 604*a*, 604*b*, 604*c* proximate to the inner surface 804 of the drill collar 802. In block 906, the compression force is removed from to the centralizer fins 604*a*, 604*b*, 604*c*. The removal of the compression force may allow each of the centralizer fins 604*a*, 604*b*, 604*c* to contact an inner surface 804 of the drill collar 802. In some aspects, the centralizer fins 604*a*, 604*b*, 604*c* may return to their original shape. In other aspects, the centralizer fins 604*a*, 604*b*, 604*c* may remain partially deformed, with the amount of deformation being dependent on the diameter of the inner surface 804 of the drill collar 802. In some aspects, the removal of the compression force may be performed as the centralizer 600 is positioned internal to the drill collar 802. For example, the centralizer 600 may be partially inserted into the drill collar 802. The compression force may be removed from the compression force with the inner surface 804 of the drill collar 802 preventing the centralizer fins 604*a*, 604*b*, 604*c* from returning to their original shape. The remaining portions of the centralizer 600 may be slid or otherwise positioned internal to the drill collar 802 and the drill collar 802 may retain the centralizer fins 604*a*, 604*b*, 604*c* in a deformed state as the compression force is removed.

In some aspects, the centralizer assemblies are provided according to one or more of the following examples:

Example #1

A centralizer may include a centralizer body including a through-bore for receiving a drilling component. The centralizer may also include a centralizer fin radially extending from the centralizer body. The centralizer fin may include one or more chambers defined therein. The one or more chambers may be responsive to a compression force on the centralizer fin in positioning the centralizer internally to a drill collar by changing shape such that the centralizer fin deforms.

Example #2

The centralizer of Example #1 may feature the centralizer fin being made from a material. The centralizer may also feature the one or more chambers being devoid of the material.

Example #3

The centralizer of Examples #1-2 may feature the material comprising a rubber material or a plastic material.

Example #4

The centralizer of Examples #1-3 may feature the one or more chambers comprising a plurality of chambers. The plurality of chambers may include a center chamber and an end chamber. Each of the center chamber and the end chamber may have an oblong shape with a flat edge. The center chamber may be positioned in the centralizer fin to create a parallel relationship between the flat edge and an end surface of the centralizer fin. The end chamber may be positioned in the centralizer fin to create an angled relationship between the flat edge and the end surface of the centralizer fin.

Example #5

The centralizer of Examples #1-4 may further include a split-ring clamp positionable proximate to an end portion of the centralizer body to prevent axial movement of the centralizer body. The split-ring clamp may be compressible around the drilling component in response to an end cap being positioned external to the split-ring clamp and torqued to the end portion of the centralizer body subsequent to the drilling component being positioned in the through-bore.

Example #6

The centralizer of Examples #1-5 may feature the split-ring clamp including a tapered edge for mating with a corresponding tapered edge of the end cap to prevent the axial movement of the centralizer body subsequent to the end cap being torqued to the end portion of the centralizer body.

Example #7

The centralizer of Examples #1-6 may also include the end cap having a passage for receiving the split-ring clamp. The end cap may include a tapered edge for mating with a corresponding tapered edge of the split-ring clamp to couple the split-ring clamp and the centralizer body to the drilling component subsequent to the end cap being torqued to the end portion of the centralizer body.

Example #8

The centralizer of Examples #1-7 may feature the centralizer fin including a rubber material or a plastic material.

Example #9

The centralizer of Examples #1-8 may feature the centralizer fin being positionable internal to the drill collar to reduce vibrations of one or more components of a drill string during operation of the drill string.

Example #10

A centralizer assembly may include a drill collar and a centralizer. The centralizer may include a centralizer body having a through-bore. The centralizer may also include one or more centralizer fins radially extending from the centralizer body and having a plurality of chambers defined therein. The plurality of chambers may be responsive to a compression force on the centralizer fin in positioning the centralizer internally to the drill collar by changing shape such that the centralizer fin deforms. The centralizer assembly may also include a split-ring clamp positionable proximate to the centralizer body. The split-ring clamp may also be compressible around a drilling component positioned in the through-bore of the centralizer body.

Example #11

The centralizer assembly of Example #10 may feature the one or more centralizer fins being positionable to contact an inner surface of the drill collar in response to a removal of the compression force to reduce vibrations in the drill collar during operation of a drill string.

Example #12

The centralizer assembly of Examples #10-11 may feature the one or more centralizer fins being made from a material comprising rubber or plastic. The plurality of chambers may be devoid of the material.

Example #13

The centralizer assembly of Examples #10-12 may feature the plurality of chambers including one or more center chambers and at least two end chambers. Each of one or more center chamber and the at least two end chambers may have an oblong shape with a flat edge. The one or more center chambers may be positioned in the centralizer fin to create a parallel relationship between the flat edge of each of the one or more center chambers and an end surface of the centralizer fin. Each of the at least two end chambers may be positioned in the centralizer fin to create an angled relationship between the flat edge of each of the at least two end chambers and the end surface of the centralizer fin.

Example #14

The centralizer assembly of Examples #10-13 may feature the split-ring clamp including a split for allowing the split-ring clamp to compress around the drilling component. The split-ring clamp may also include the split for applying a load to the drilling component when the split-ring clamp is compressed around the drilling component.

Example #15

The centralizer assembly of Examples #10-14 may further include an end cap for compressing the split-ring clamp around a part of the drilling component. The end cap may include a tapered edge for mating with a corresponding tapered edge of the split-ring clamp by torquing the end cap to an end portion of the centralizer body.

Example #16

A method for installing a centralizer in a drill collar may include providing the centralizer having one or more centralizer fins extending from a centralizer body of the centralizer. The method may also include applying a compression force on the one or more centralizer fins to deform the at least one of the one or more centralizer fins based on a position of one or more chambers in the one or more centralizer fins. The method may also include positioning the centralizer internal to the drill collar. The method may also include removing the compression force to allow each of the one or more centralizer fins to contact an inner surface of the drill collar.

Example #17

The method of Example #16 may also include positioning a split-ring clamp proximate to an end portion of the centralizer body and around a drilling component positioned in a through-bore of the centralizer body. The method may also include positioning the split-ring clamp internal to a passage of an end cap. The method may also include torquing the end cap to the end portion of the centralizer body to allow the split-ring clamp to apply a load on the drilling component.

Example #18

The method of Examples #16-17 may feature torquing the end cap to the end portion of the centralizer body to include mating a tapered edge of the end cap with a corresponding tapered edge of the split-ring clamp.

Example #19

The method of Examples #16-18 may feature the one or more chambers being positioned to extend from a first outer surface of the one or more centralizer fins to a second outer surface of the one or more centralizer fins. The method may further feature applying the compression force on the one or more centralizer fins to include causing a shape of at least one of the one or more chambers to change.

Example #20

The method of Examples #16-19 may feature applying the compression force on the one or more centralizer fins to include deforming the one or more centralizer fins to produce a compressed centralizer having an outer diameter that is less than an inner diameter of the drill collar.

The foregoing description of the disclosure, including illustrated aspects and examples has been presented only for the purpose of illustration and description and is not intended to be exhaustive or to limit the disclosure to the precise forms disclosed. Numerous modifications, adaptations, and uses thereof will be apparent to those skilled in the art without departing from the scope of this disclosure. Aspects and features from each disclosed example may be combined with any other example.

What is claimed is:

1. A centralizer comprising:

a centralizer body including a through-bore for receiving a drilling component; and a centralizer fin radially extending from the centralizer body, the centralizer fin including one or more chambers defined therein that extend from a first outer surface to a second outer surface of the centralizer fin along an axis that is perpendicular to a longitudinal axis of the centralizer body, the one or more chambers being responsive to a compression force on the centralizer fin in positioning the centralizer internally to a drill collar by changing shape such that the centralizer fin deforms.

2. The centralizer of claim 1, wherein the centralizer fin is made from a material, wherein the one or more chambers are devoid of the material.

3. The centralizer of claim 2, wherein the material comprises a rubber material or a plastic material.

4. The centralizer of claim 1, wherein the one or more chambers comprises a plurality of chambers including a center chamber and an end chamber, each of the center chamber and the end chamber having an oblong shape with a flat edge, wherein the center chamber is positioned in the centralizer fin to create a parallel relationship between the flat edge of the center chamber and an end surface of the centralizer fin, wherein the end chamber is positioned in the centralizer fin to create an angled relationship between the flat edge of the end chamber and the end surface of the centralizer fin.

5. The centralizer of claim 1, further comprising a split-ring clamp positionable proximate to an end portion of the centralizer body to prevent axial movement of the centralizer body, wherein the split-ring clamp is compressible around the drilling component in response to an end cap being positioned external to the split-ring clamp and torqued to the end portion of the centralizer body subsequent to the drilling component being positioned in the through-bore.

6. The centralizer of claim 5, wherein the split-ring clamp includes a tapered edge for mating with a corresponding tapered edge of the end cap to prevent the axial movement of the centralizer body subsequent to the end cap being torqued to the end portion of the centralizer body.

7. The centralizer of claim 5, further including the end cap having a passage for receiving the split-ring clamp, the end cap including a tapered edge for mating with a corresponding tapered edge of the split-ring clamp to couple the split-ring clamp and the centralizer body to the drilling component subsequent to the end cap being torqued to the end portion of the centralizer body.

8. The centralizer of claim 1, wherein the centralizer fin is positionable to contact an inner surface of the drill collar in response to a removal of the compression force to reduce vibrations in the drill collar during operation of a drill string.

9. The centralizer of claim 1, wherein the centralizer fin is positionable internal to the drill collar to reduce vibrations of one or more components of a drill string during operation of the drill string.

10. A centralizer assembly, comprising:

a drill collar;

a centralizer including:

a centralizer body having a through-bore, and one or more centralizer fins radially extending from the centralizer body and having a plurality of chambers defined therein, the plurality of chambers being responsive to a compression force on the one or more centralizer fins in positioning the centralizer internally to the drill collar by changing shape such that the one or more centralizer fins deform; and a split-ring clamp positionable proximate to the centralizer body and compressible around a drilling component positioned in the through-bore of the centralizer body.

11. The centralizer assembly of claim 10, wherein the one or more centralizer fins are positionable to contact an inner surface of the drill collar in response to a removal of the compression force to reduce vibrations in the drill collar during operation of a drill string.

12. The centralizer assembly of claim 10, wherein the one or more centralizer fins are made from a material comprising rubber or plastic, wherein the plurality of chambers are devoid of the material.

13. The centralizer of claim 10, wherein the plurality of chambers including one or more center chambers and at least two end chambers positioned in at least one of the one or more centralizer fins, each of one or more center chamber and the at least two end chambers having an oblong shape with a flat edge, wherein the one or more center chambers are positioned in the least one of the one or more centralizer fins to create a parallel relationship between the flat edge of each of the one or more center chambers and an end surface of the least one of the one or more centralizer fins, wherein each of the at least two end chambers is positioned in the least one of the one or more centralizer fins to create an angled relationship between the flat edge of each of the at least two end chambers and the end surface of the least one of the one or more centralizer fins.

14. The centralizer of claim 10, wherein the split-ring clamp includes a split for allowing the split-ring clamp to compress around the drilling component and for applying a load to the drilling component when the split-ring clamp is compressed around the drilling component.

15. The centralizer assembly of claim 10, further comprising an end cap for compressing the split-ring clamp around a part of the drilling component, the end cap including a tapered edge for mating with a corresponding tapered edge of the split-ring clamp by torquing the end cap to an end portion of the centralizer body.

16. A method for installing a centralizer in a drill collar, comprising:

providing the centralizer having one or more centralizer fins extending from a centralizer body of the centralizer;

applying a compression force on the one or more centralizer fins to deform the one or more centralizer fins based on a position of one or more chambers in the one or more centralizer fins;

positioning the centralizer internal to the drill collar; and removing the compression force to allow each of the one or more centralizer fins to contact an inner surface of the drill collar.

17. The method of claim 16, further comprising:

positioning a split-ring clamp proximate to an end portion of the centralizer body and around a drilling component positioned in a through-bore of the centralizer body;

positioning the split-ring clamp internal to a passage of an end cap;

torquing the end cap to the end portion of the centralizer body to allow the split-ring clamp to apply a load on the drilling component.

18. The method of claim 17, wherein torquing the end cap to the end portion of the centralizer body includes mating a tapered edge of the end cap with a corresponding tapered edge of the split-ring clamp.

19. The method of claim 16, wherein the one or more chambers are positioned to extend from a first outer surface of the one or more centralizer fins to a second outer surface of the one or more centralizer fins, wherein applying the compression force on the one or more centralizer fins causes a shape of at least one of the one or more chambers to change.

20. The method of claim 16, wherein applying the compression force on the one or more centralizer fins includes deforming the one or more centralizer fins to produce a compressed centralizer having an outer diameter that is less than an inner diameter of the drill collar.

* * * * *